US006653774B2

(12) United States Patent
Kunitomo et al.

(10) Patent No.: US 6,653,774 B2
(45) Date of Patent: Nov. 25, 2003

(54) FUNNEL FOR CATHODE RAY TUBE

(75) Inventors: Kazunobu Kunitomo, Otsu (JP); Hajime Yoshino, Otsu (JP)

(73) Assignee: Nippon Electric Glass Co., Ltd., Shiga-Ken (JP)

( * ) Notice: Subject to any disclaimer, the term of this patent is extended or adjusted under 35 U.S.C. 154(b) by 28 days.

(21) Appl. No.: 10/125,773

(22) Filed: Apr. 17, 2002

(65) Prior Publication Data

US 2002/0171354 A1 Nov. 21, 2002

(51) Int. Cl.[7] ..... H01J 31/00

(52) U.S. Cl. ..... 313/477 R; 313/481; 313/553; 417/48

(58) Field of Search ..... 313/477 R, 481, 313/44, 553, 554, 555, 556, 557, 558, 559, 560, 561, 562, 482, 477 HC; 417/48, 49, 50, 51

(56) References Cited

U.S. PATENT DOCUMENTS 6,310,435 B1 * 10/2001 Hageluken et al. ..... 313/481

* cited by examiner

*Primary Examiner*—Nimeshkumar D. Patel
*Assistant Examiner*—Jason Phinney
(74) *Attorney, Agent, or Firm*—J. C. Patents

(57) ABSTRACT

On an inner wall of a side wall portion of a funnel, a pair of protrusions are integrally formed as glass buildups at positions separated by a predetermined distance from an anode button toward a side of a neck tube. The pair of the protrusions are formed symmetrically on both sides of a virtual baseline extending to an seal edge surface and the neck tube through the center of the anode button. The virtual baseline is an intersection between a virtual plane including a tube axis and the inner wall, and passes through approximately the center of the seal edge surface in the lengthwise side.

18 Claims, 4 Drawing Sheets

FUNNEL FOR CATHODE RAY TUBE

BACKGROUND OF THE INVENTION

The present invention relates to a funnel used for a cathode ray tube, and specifically relates to a funnel for a cathode ray tube, on an inner wall of a side wall portion of which an anode button is sealed for mounting a getter mounting body and protrusions are formed for restricting a turn of the getter mounting body around the anode button.

As is well known, a cathode ray tube includes a panel on which an image is projected, a funnel, and a neck tube in a tube shape with a small diameter as principal glass parts. As shown in FIG. 5, a funnel 1 is provided with a side wall portion 4 which is gradually decreasing in diameter in a direction from a seal edge surface 2 provided for sealing the panel toward a neck tube 3. An anode button 6 is sealed and embedded at a predetermined position on an inner wall 5 of the side wall portion 4. Frit glass is used for fusing to join the seal edge surface 2 of the funnel 1 to a seal edge surface of the panel in a manufacturing process for the cathode ray tube, and this process seals the panel to the funnel 1.

The funnel 1 is molded such that high temperature molten glass gob is supplied to a mold comprising a bottom mold and a shell mold, in this state, a plunger is pressed against the gob to apply a pressing force, thereby, the molten glass gob moves up to a part corresponding to the side wall portion 4 in a direction toward the seal edge surface 2 while the molten glass gob is pressed and extended.

On the other hand, in the manufacturing process for the cathode ray tube after molding the funnel 1, the inside of the cathode ray tube is evacuated after the funnel 1 is sealed to the panel, a high frequency irradiation from the outside of the cathode ray tube heats and vaporizes getter 7 such as barium held on the inner wall 5 of the funnel 1, the getter 7 reacts with a small amount of residual air remaining inside the cathode ray tube, and thereby the vacuum increases to about $10^{-6}$ Pa.

As means for holding the getter 7 on the inner wall 5 of the funnel 1 in a preceding process, the getter 7 is mounted to one end of an elastic metal piece 8, which serves as a mounting member, to form a getter mounting body 10, the elastic metal piece 8 is attached to the anode button 6 sealed and embedded on the inner wall 5 of the side wall portion 4, and an elastic force of the elastic metal piece 8 presses the getter 7 against the inner wall 5 of the side wall portion 4. When the elastic metal piece 8 is attached to the anode button 6, a protruding terminal in a spherical or cylindrical shape formed on the anode button 6 is engaged with an engaging hole 8*a* formed through the elastic metal piece 8.

The elastic force of the elastic metal piece 8 to which the getter 7 is attached simply allows the anode button 6 to support the elastic metal piece 8. When a mechanical vibration acts during transporting or handling the cathode ray tube, the elastic metal piece 8 turns around the anode button 6, and the position of the getter 7 is displaced from a desired initial position.

As a result, when the high frequency heating is performed on the getter 7 from the outside of the cathode ray tube after the panel is sealed to the funnel 1, because the target is so displaced that the heating and vaporizing of the getter is obstructed, an inner atmosphere in the cathode ray tube does not reach required high vacuum, and defective emission of the electron beam, and consequently, a degraded picture receiving characteristic are generated. In this case, because the inside of the cathode ray tube is evacuated, it is extremely difficult to adjust the getter position, and consequently it becomes impossible to apply the cathode ray tube to a practical use.

To solve this problem, Japanese Utility Model Laid-Open Publication No. Hei. 3-8855 discloses a technology wherein a pair of protrusions made of glass-buildups are formed on the inner wall 5 of the funnel 1. Namely, a pair of the protrusions 9 are formed in a neighborhood of the anode button 6 on the inner wall 5 so as to clamp the elastic metal piece 8 from the both sides, and the existence of the pair of protrusions 9 prevents the getter mounting body 10 from turning around the anode button 6.

However, prior art including the disclosed technology in the publication gives no consideration to the shape of the protrusions 9, and the protrusions 9 are simply formed just for preventing the turn of the getter mounting body 10. Specifically, as shown in FIG. 6, the conventional protrusions 9 are formed such that the most protruded part 9*a* on the basis of the inner wall 5 of the funnel 1 continues to the inner wall 5 at a side of the seal edge surface 2 through a first slope 9*b*, and the most protruded parts 9*a* continues to the inner wall 5 at a side of the neck 3 through a second slope 9*c*. The first slope 9*b* and the second slope 9*c* are set to the same inclination, namely the same slope angle, on the basis of the inner wall 5.

In this case, there is a large difference in flow speed between the molten glass flowing on parts corresponding to the protrusions 9 and the molten glass flowing on parts corresponding to the inner wall 5 in the neighborhoods of the protrusions 9, which are not protruded, when the molten glass moves up on the part corresponding to the side wall portion 4 toward the seal edge surface 2. When the two flows of the molten glass are different from each other in the flow speed and they merge together in the neighborhoods of the end parts at the side of the seal edge surface 2 corresponding to the protrusions 9, the flow of the molten glass is disturbed and obstructed in the neighborhoods of the end parts. As a result, in the molded funnel 1, a defective molding such as a wrinkle or a crack is generated in the neighborhoods of the ends of the protrusions 9 at the side of the seal edge surface 2.

SUMMARY OF THE INVENTION

In view of the foregoing, an object of the present invention is to improve the constitution of the protrusions formed on the inner wall of the funnel for preventing the turn of the getter mounting body, thereby to effectively smooth the flow of the molten glass in the neighborhoods of the protrusions when the funnel is molded, and to prevent the generation of the defective molding such as a wrinkle or a crack.

To attain the object above, the present invention provides a funnel for a cathode ray tube, comprising a seal edge surface provided for sealing a panel, a side wall portion gradually decreasing in diameter in a direction from the seal edge surface to a neck tube side, an anode button sealed on an inner wall of the side wall portion to which a getter mounting body comprising a getter and a mounting member is attached, and at least a pair of protrusions formed for restricting the getter mounting body from turning around the anode button from both sides, wherein each of the protrusions continues to the inner wall of the side wall portion as forming slopes from the most protruded part thereof toward the seal edge surface side and the neck tube side, and an inclination of the slope at the seal edge surface side is smaller than an inclination of the slope at the neck tube side.

With this constitution, because the inclination of the slope at the seal edge surface side is smaller than the inclination of the slope at the neck tube side for the most protruded parts of the protrusions, the following advantages are gained when the molten glass moves up on the part corresponding to the side wall portion toward the seal edge surface in the previously described process for molding the funnel. That is, even when there is a difference in the flow speed between the molten glass flowing on the part corresponding to the most protruded parts on the protrusions and the molten glass flowing on the part corresponding to the inner wall in the neighborhood of the protrusions, which are not protruded, one of the molten glass flows passes on the slopes at the seal edge surface side with the small inclination. Thereby, when it merges with the other of the molten glass flows during or after the passage, the difference in the flow speed between both of them properly decreases, and the directions of the flow of them become relatively similar. Thus, the situation where both of them disturb the mutual flows is restrained, and disturbance hardly occurs at the merging parts. As a result, a wrinkle or a crack is efficiently prevented from occurring in the neighborhoods of the ends of the protrusions at the seal edge surface side in the molded funnel.

In this case, the height of the most protruded part of the protrusion is set to a range of 0.5 mm to 1.5 mm, for example, on the basis of the inner wall. If the height is less than 0.5 mm, a proper turn preventing feature is not provided for the getter mounting body. If the height is more than 1.5 mm, the difference in the flow speed between the two flows of the molten glass is excessively large, and it is impossible to surely prevent the generation of the defective molding. And the inclination of the slope of the most protruded part at the seal edge surface side is set to a range of 2° to 10° on the basis of the inner wall, for example, and the slope at the neck tube side is set to a range of 7° to 20°, for example. If the inclination of the slope at the seal edge surface side is less than 2°, the length of the slope toward the seal edge surface is excessively long. If it is more than 10° disturbance occurs at the part where two flows of the molten glass merge, and it is impossible to surely prevent the generation of the defective molding. If the inclination of the slope at the neck tube side is less than 7°, sufficient height of the protrusion is not obtained, or the entire length of the protrusion from the neck tube side to the seal edge surface side is excessively long. If it is more than 20°, the slope prevents the flow of the molten glass, and another defective molding may occur in the neighborhoods of the ends of the protrusions at the neck tube side. The forms of the slopes at the seal edge surface side and the neck tube side may be a line or a high-order curve.

It is preferable that each of the protrusions further continues to the inner wall of the side wall portion as forming slopes from the most protruded part toward the getter mounting body side and the opposite side of the getter mounting body side, and an inclination of the slope at the opposite side of the getter mounting body side is smaller than an inclination of the slope at the getter mounting body side.

In this constitution, each of the protrusions comprises not only the slope from the most protruded part at the side of the getter mounting body, which opposes to the slope of the other protrusion disposed through the getter mounting body, but also the slope from the most protruded part at the opposite side of the getter mounting body. Thus, the flow of the molten glass all around the protrusions is smoothed, a temperature change caused by an excessive glass thickness change around the most protruded parts of the protrusions, and a resulting stress concentration are avoided when the funnel is molded, and it is possible to prevent the defective molding from occurring more surely. Further, because the inclination of the slope at the opposite side of the getter mounting body is set to smaller than that at the getter mounting body side, it is possible to efficiently prevent the defective molding from occurring while the turn preventing feature of the protrusions for the getter mounting body is properly secured. In terms of molding, it is preferable that curved surfaces with predetermined curvature radius be formed on bent parts where the slopes at the getter mounting body side and the opposite side of the getter mounting body from the most protruded part continue to the inner wall. It is preferable that a section shape obtained by cutting the protrusion in parallel with the inner wall be a shape whose width gradually decreases toward the opposite side of the getter mounting body, such as a shape close to a partial ellipse or a trapezoid.

Further, it is preferable that the protrusions be formed approximately symmetrically on both sides of a virtual baseline which passes through the center of the anode button and extends to the seal edge surface and the neck tube. With this constitution, a mutual positional relationship among the anode button and the individual protrusions is corrected, a geometrical deviation in attaching the getter mounting body to the anode button is eliminated, and a geometrical deviation in the state of the individual protrusions for preventing the turn of the getter mounting body (the clamping state) is restrained from occurring. As a result, the turn of the getter mounting body around the anode button is properly prevented.

It is preferable that each of the protrusions be formed such that a length thereof in a direction parallel with the virtual baseline is longer than a width in a direction perpendicular to the baseline. With this constitution, forming only the pair of the protrusions is possible to secure the length of the protrusions required for preventing the turn of the getter mounting body, and to decrease the width of the protrusions. As a result, the overall size and the number of the protrusions can be decreased, and consequently, the product cost can be reduced.

It is preferable that a side surface of the protrusion at the getter mounting body side be formed almost linear in a direction parallel with the virtual baseline. With this constitution, when the getter is circular, or the mounting member is rectangular, the protrusions surely clamp the getter mounting body. As a result, convenience increases, and the work for making the getter held on the funnel inner wall can be simplified.

It is preferable that the virtual baseline be an intersection between a virtual plane including a tube axis of the funnel and the inner wall of the side wall portion, and pass through approximately the center in a side direction of the seal edge surface. With this constitution, it is easy to design the shape of the protrusions, and to machine and manufacture the mold for the molding.

DETAILED DESCRIPTION OF THE PREFERRED EMBODIMENTS

Figure 5:
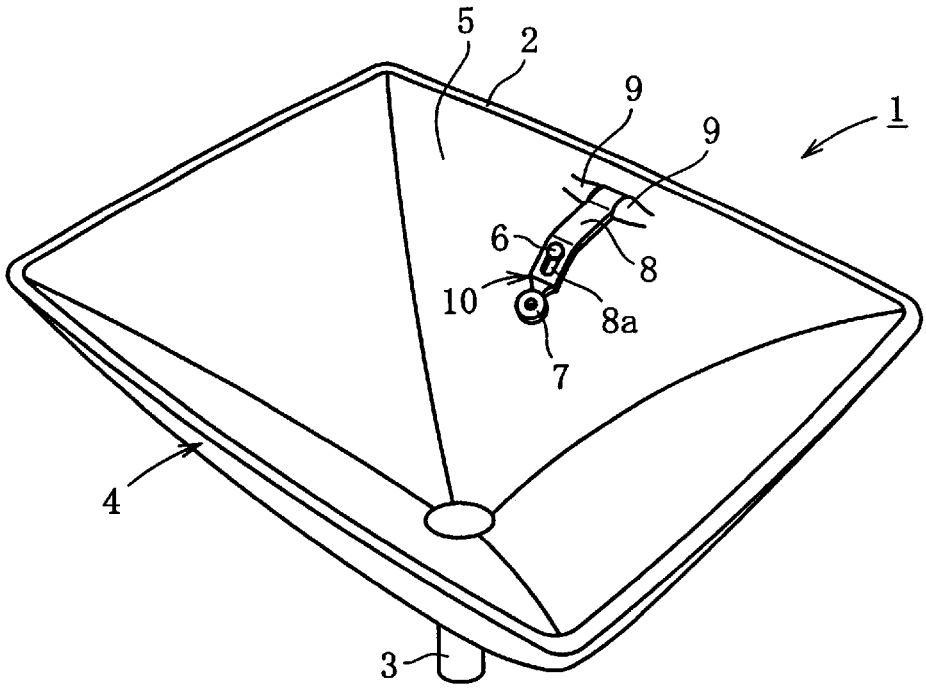
FIG. 5 (PRIOR ART)
FIG. 5 is a perspective view showing a conventional funnel.
Figure 6:
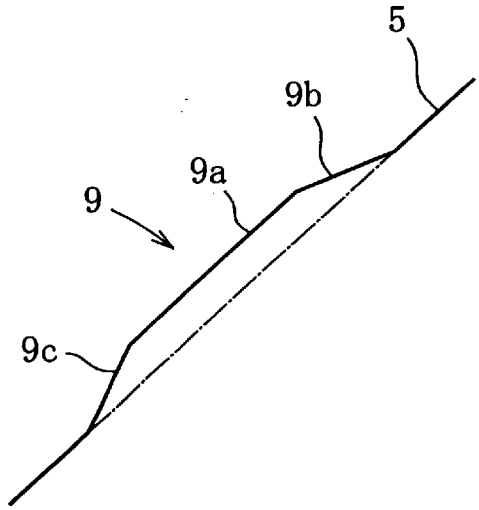
FIG. 6 (PRIOR ART)
FIG. 6 is an enlarged lengthwise sectional side view showing a principal part of protrusions formed on the conventional funnel.

Embodiments of the present invention will be described below with reference to the drawings. Constitution elements common to those in FIG. 5 and FIG. 6 are given the same numerals and detailed description for them is omitted in the description based on FIG. 1 to FIG. 4.

Figure 1:
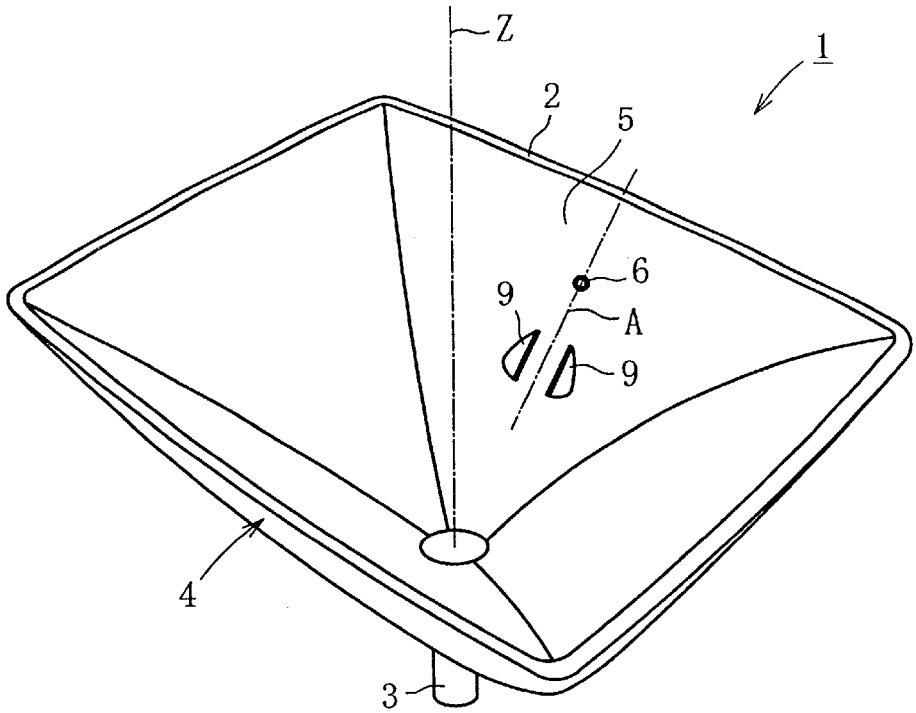
FIG. 1 is a perspective view of a funnel according to an embodiment of the present invention.
Figure 2:
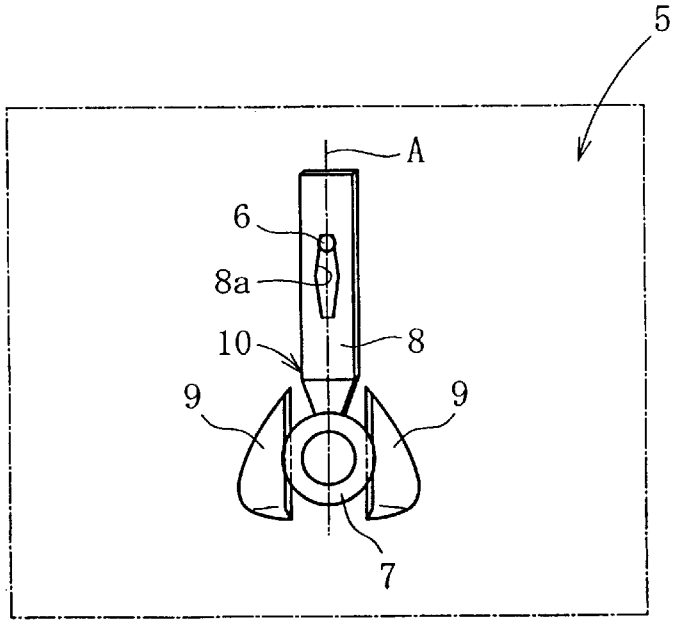
FIG. 2 is a magnified front view showing a principal part of the funnel according to the present invention.
Figure 3A:
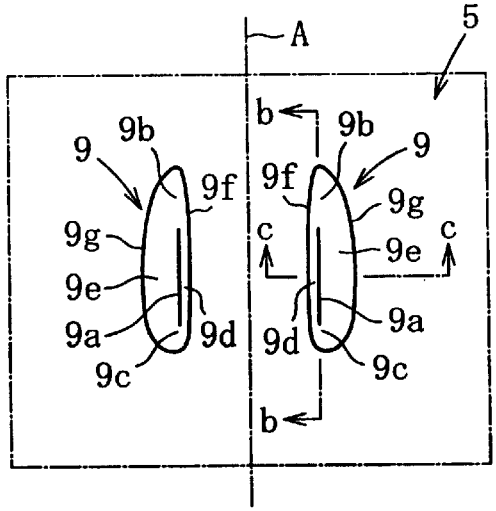
FIG. 3(*a*) is an enlarged front view showing a principal part of a neighborhood of an example of protrusions formed on the funnel, FIG. 3(*b*) is a sectional view taken along the line b—b in FIG. 3(*a*), and FIG. 3(*c*) is a sectional view taken along the line c—c in FIG. 3(*a*)
Figure 3B:
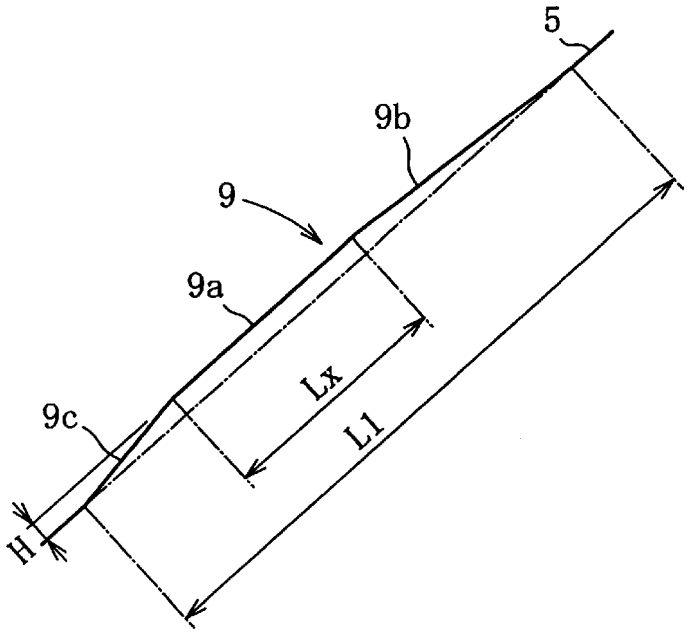
Figure 3C:
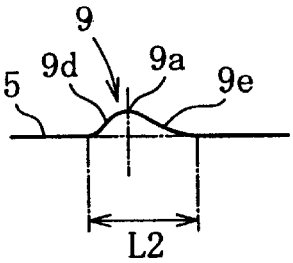

FIG. 1 is a perspective view showing a funnel for a cathode ray tube 1 (simply referred as a funnel 1 hereafter) according to a present embodiment. FIG. 2 is a front view showing a state where the funnel 1 retains a getter 7. FIG. 3 includes a front view for showing protrusions 9 formed on the funnel 1 (FIG. 3(*a*)), a longitudinal sectional side view (FIG. 3(*b*)), and a lateral sectional bottom view (FIG. 3(*c*)).

As shown in FIG. 1, a single anode button 6 is sealed and embedded at a predetermined position on an inner wall 5 of a side wall portion 4 of the funnel 1. The anode button 6 has a head in a cone shape whose diameter gradually increases toward the end. On the inner wall 5, a pair of protrusions 9 are integrally formed as glass buildups at positions separated by a predetermined distance from the anode button 6, in the present embodiment, separated toward a side of a neck tube 3 from the anode button 6. The pair of the protrusions 9 are formed symmetrically on both sides of a virtual baseline A extending to the seal edge surface 2 and the neck tube 3 through the center of the anode button 6. The virtual baseline A is an intersection between a virtual plane including a tube axis Z and the inner wall 5, and passes through approximately the center of the seal edge surface 2 in the lengthwise side.

As shown in FIG. 2, the anode button 6 supports a getter mounting body 10 which comprises an elastic metal piece 8 and a getter 7 mounted thereto. In more detail, the head of the anode button 6 engages an engaging hole 8*a* formed approximately at the center of the elastic metal piece 8. An elastic force generated as a result of forming the elastic metal piece 8 in a bent state maintains the engagement. The pair of the protrusions 9 support the ring-shape getter 7 such that the protrusions 9 clamp the ring-shape getter 7 attached on the one end of the elastic metal piece 8 from the both sides in the present embodiment. As a result, the turn of the getter mounting body 10 around the anode button 6 is restricted. In place of forming the protrusions 9 so as to clamp the getter 7 from the both sides thereof, the protrusions 9 may be formed so as to clamp the elastic metal piece 8 from the both sides thereof, or to clamp both the getter 7 and the elastic metal piece 8.

The protrusions 9 seen from the front (its shape seen vertically to the inner wall 5) has a lengthwise extending shape. The length L1 in a direction parallel with the virtual baseline A is longer than the width L2 orthogonal to the lengthwise direction as shown in FIG. 3(*a*). Also, a side edge 9*f* at the side of the getter mounting body (the side facing toward the center between the pair of the protrusions 9) curves with a smaller curvature than a side edge 9*g* at the opposite side of the getter mounting body. A part 9*a* having the highest height on the basis of the inner wall (hereafter, called as "the most protruded part 9*a*") extends in parallel with the virtual baseline-A and is positioned closer to the getter mounting body than the center in a direction of the width L2 on the protrusion 9. In the present embodiment, a side surface 9*d* at the getter mounting body side of the protrusion 9 (a slope 9*d* at the getter mounting body side of the most protruded part 9*a*) is formed almost linear.

As shown in FIG. 3(*b*), the protrusion 9 continues to the inner wall 5 as forming slopes from the most protruded part 9*a* having a length of Lx toward the seal edge surface 2 (in an obliquely upward direction in the same Figure), and toward the neck tube 3 (in an obliquely downward direction in the same Figure). An inclination of a slope 9*b* at the side of the seal edge surface 2 is set smaller than an inclination of a slope 9*c* at the side of the neck tube 3 on the basis of the inner wall 5. Specifically, the length L1 of the protrusion 9 is 24 mm. The length Lx of the most protruded part 9*a* is 9 mm. The height H of the most protruded part 9*a* is 0.8 mm on the basis of the inner wall 5. The inclination of the slope 9*b* at the side of the seal edge surface 2 on the basis of the inner wall 5 is 4.5°. The inclination of the slope 9*c* at the side of the neck tube 3 on the basis of the inner wall 5 is 9°. The pair of the protrusions 9 are formed with an interval of 16 mm.

As shown in FIG. 3(*c*), the protrusion 9 continues from the most protruded part 9*a* to the inner wall 5 through slopes at the getter mounting side (the left side in the same Figure) and at the opposite side of the getter mounting body (the right side in the same Figure) in a direction of the width L2 thereof. An inclination of a slope 9*e* at the opposite side of the getter mounting body is set to smaller than an inclination of the slope 9*d* at the getter mounting side on the basis of the inner wall 5. Specifically, a top including the most protruded part 9*a* forms a convex arc with a curvature radius of 0.8 mm. The joint portion of the slope 9*d* to the inner wall 5 at the getter mounting side forms a concave arc with a curvature radius of 1.5 mm. The joint portion of the slope 9*e* to the inner wall 5 at the opposite side of the getter mounting body forms a concave arc with a curvature radius of 10 mm.

Figure 4A:
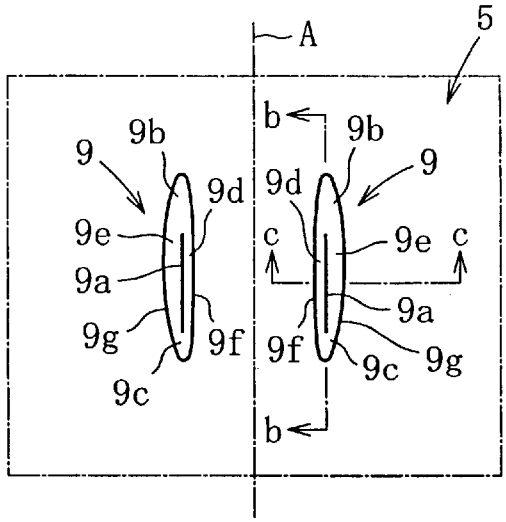
FIG. 4(*a*) is an enlarged front view showing a principal part of a neighborhood of an alternative example of protrusions formed on the funnel, FIG. 4(*b*) is a sectional view taken along the line b—b in FIG. 4(*a*), and FIG. 4(*c*) is a sectional view taken along the line c—c in FIG. 4(*a*)
Figure 4B:
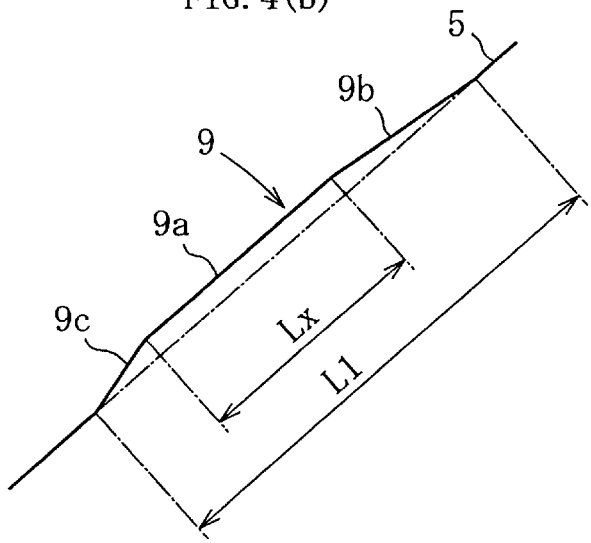
Figure 4C:
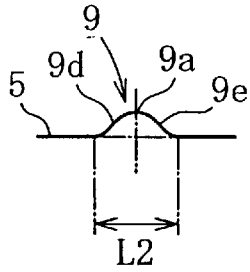

FIG. 4 exemplifies an alternative embodiment of the funnel 1 according to the present invention. The following section lists differences of the protrusion 9 in the present embodiment from that in the previous embodiment. The dimension in the direction of the width L2 is shorter, and the most protruded part 9*a* exists approximately at the center in the direction of the width L2 as shown in FIG. 4(*a*). Also, the inclinations of the most protruded part 9*a* at the sides of the seal edge 2 and the neck tube 3 are larger respectively, and, as a result, the length L1 is shorter as shown in FIG. 4(*b*). Further, the inclination of the slope 9*d* at the getter mounting body side and the inclination of the slope 9*e* at the opposite side of the getter mounting body are almost equal to each other as shown in FIG. 4(*c*). Specifically, the length L1 of the protrusion 9 is 18 mm. The inclination of the slope 9*b* at the side of the seal edge surface 2 on the basis of the inner wall 5 is 7.5°. The inclination of the slope 9*c* at the side of the neck tube 3 on the basis of the inner wall 5 is 15°. The curvature radius of the joint portions of the slope 9*d* to the inner wall 5 at the getter mounting side and the slope 9*e* to the inner wall 5 on the opposite side of the getter mounting body are 1.5 mm respectively. Dimensions of the other parts are equal to those of the protrusion 9 relating to the previous embodiment. Constitution elements in FIG. 4 common to those of the protrusion 9 according to the previous embodiment are given the same numerals and description for them is suppressed.

While the protrusions 9 are formed at the side of the neck tube 3 with respect to the anode button 6 in the embodiments, the protrusions 9 may be formed at the side of the seal edge surface 2 with respect to the anode button 6.

While the most protruded part 9*a*, the slope 9*b* at the side of the seal edge surface 2, and the slope 9*c* at the side of the neck tube 3 of the protrusion 9 are formed with line portions continuing to each other as forming bends in the embodiments, these portions 9*a*, 9*b* and 9*c* may be continued integrally curvedly to each other without bents.

Further, while the pair of the protrusions 9 clamp the getter 7 and/or the mounting member 8 from the both sides in the embodiments, three or more protrusions 9 having the same constitution may clamp the getter 7 and/or the mounting member 8 from the both sides.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A funnel for a cathode ray tube comprising;

a seal edge surface provided for sealing a panel;

a side wall portion gradually decreasing in diameter in a direction from the seal edge surface to a neck tube side;

an anode button sealed on an inner wall of the side wall portion to which a getter mounting body comprising a getter and a mounting member is attached; and at least a pair of protrusions formed for restricting the getter mounting body from turning around the anode button from both sides, wherein each of the protrusions continues to the inner wall of the side wall portion as forming slopes from the most protruded part thereof toward the seal edge surface side and the neck tube side, and an inclination of the slope at the seal edge surface side is smaller than an inclination of the slope at the neck tube side.

2. The funnel for a cathode ray tube according to claim 1, wherein each of the protrusions further continues to the inner wall of the side wall portion as forming slopes from the most protruded part toward the getter mounting body side and the opposite side of the getter mounting body side, and an inclination of the slope at the opposite side of the getter mounting body side is smaller than an inclination of the slope at the getter mounting body side.

3. The funnel for a cathode ray tube according to claim 1, wherein the protrusions are formed approximately symmetrically at both sides of a virtual baseline which passes through the center of the anode button and extends to the seal edge surface and the neck tube.

4. The funnel for a cathode ray tube according to claim 2, wherein the protrusions are formed approximately symmetrically at both sides of a virtual baseline which passes through the center of the anode button and extends to the seal edge surface and the neck tube.

5. The funnel for a cathode ray tube according to claim 3, wherein each of the protrusions is formed such that a length thereof in a direction parallel with the virtual baseline is longer than a width in a direction perpendicular to the virtual base line.

6. The funnel for a cathode ray tube according to claim 4, wherein each of the protrusions is formed such that a length thereof in a direction parallel with the virtual baseline is longer than a width in a direction perpendicular to the virtual base line.

7. The funnel for a cathode ray tube according to claim 3, wherein each of the protrusions is formed such that a side surface thereof at the getter mounting body side is almost linear in a direction parallel with the virtual baseline.

8. The funnel for a cathode ray tube according to claim 4, wherein each of the protrusions is formed such that a side surface thereof at the getter mounting body side is almost linear in a direction parallel with the virtual baseline.

9. The funnel for a cathode ray tube according to claim 5, wherein each of the protrusions is formed such that a side surface thereof at the getter mounting body side is almost linear in a direction parallel with the virtual baseline.

10. The funnel for a cathode ray tube according to claim 6, wherein each of the protrusions is formed such that a side surface thereof at the getter mounting body side is almost linear in a direction parallel with the virtual baseline.

11. The funnel for a cathode ray tube according to claim 3, wherein the virtual baseline is an intersection between a virtual plane including a tube axis of the funnel, and the inner wall of the side wall portion, and passes through approximately the center in a lengthwise side of the seal edge surface.

12. The funnel for a cathode ray tube according to claim 4, wherein the virtual baseline is an intersection between a virtual plane including a tube axis of the funnel, and the inner wall of the side wall portion, and passes through approximately the center in a lengthwise side of the seal edge surface.

13. The funnel for a cathode ray tube according to claim 5, wherein the virtual baseline is an intersection between a virtual plane including a tube axis of the funnel, and the inner wall of the side wall portion, and passes through approximately the center in a lengthwise side of the seal edge surface.

14. The funnel for a cathode ray tube according to claim 6, wherein the virtual baseline is an intersection between a virtual plane including a tube axis of the funnel, and the inner wall of the side wall portion, and passes through approximately the center in a lengthwise side of the seal edge surface.

15. The funnel for a cathode ray tube according to claim 7, wherein the virtual baseline is an intersection between a virtual plane including a tube axis of the funnel, and the inner wall of the side wall portion, and passes through approximately the center in a lengthwise side of the seal edge surface.

16. The funnel for a cathode ray tube according to claim 8, wherein the virtual baseline is an intersection between a virtual plane including a tube axis of the funnel, and the inner wall of the side wall portion, and passes through approximately the center in a lengthwise side of the seal edge surface.

17. The funnel for a cathode ray tube according to claim 9, wherein the virtual baseline is an intersection between a virtual plane including a tube axis of the funnel, and the inner wall of the side wall portion, and passes through approximately the center in a lengthwise side of the seal edge surface.

18. The funnel for a cathode ray tube according to claim 10, wherein the virtual baseline is an intersection between a virtual plane including a tube axis of the funnel, and the inner wall of the side wall portion, and passes through approximately the center in a lengthwise side of the seal edge surface.

* * * * *